US010946249B2

(12) United States Patent
DiLorenzo

(10) Patent No.: US 10,946,249 B2
(45) Date of Patent: Mar. 16, 2021

(54) SWIM PADDLE

(71) Applicant: TYR Sport, Inc., Farmingdale, NY (US)

(72) Inventor: Matthew Vito DiLorenzo, Farmingdale, NY (US)

(73) Assignee: TYR Sport, Inc., Farmingdale, NY (US)

( * ) Notice: Subject to any disclaimer, the term of this patent is extended or adjusted under 35 U.S.C. 154(b) by 288 days.

(21) Appl. No.: 15/835,285

(22) Filed: Dec. 7, 2017

(65) Prior Publication Data

US 2019/0175991 A1 Jun. 13, 2019

(51) Int. Cl.
*A63B 31/10* (2006.01)

(52) U.S. Cl.
CPC ..... *A63B 31/10* (2013.01); *A63B 2209/00* (2013.01)

(58) Field of Classification Search
CPC ..... A63B 31/10
USPC ..... 441/55–58
See application file for complete search history.

(56) References Cited

U.S. PATENT DOCUMENTS

| | | | | |
|---|---|---|---|---|
| 1,830,450 | A | 10/1876 | Dunlop | |
| 1,014,939 | A | 1/1912 | Boman | |
| 1,051,169 | A | 1/1913 | Snell | |
| 1,179,581 | A | 4/1916 | Vimeburg | |
| 1,275,005 | A | 8/1918 | Eckman | |
| 1,395,914 | A | 11/1921 | Grundmann | |
| 1,540,368 | A | 6/1925 | Samuels | |
| 1,541,100 | A | 6/1925 | Barrett | |
| 1,621,693 | A | 9/1926 | Theobold | |
| 1,708,331 | A | 4/1929 | Ryan | |
| 1,715,571 | A | 6/1929 | Robertson | |
| 2,010,750 | A | 11/1933 | Dawzda | |
| 2,017,463 | A | 4/1934 | Komadina | |
| 2,109,429 | A | 11/1936 | Malm | |
| 2,159,972 | A | 5/1939 | Larson | |
| 2,313,979 | A * | 3/1943 | Tuma | A63B 31/08 441/58 |
| 2,317,886 | A | 4/1943 | Coddington | |
| 2,555,969 | A | 5/1950 | Holcombe | |
| 2,556,894 | A | 6/1951 | Axiotes | |
| 2,810,138 | A | 10/1957 | Cochran | |
| 2,980,925 | A | 4/1961 | Wolshin | |
| 3,023,432 | A | 3/1962 | Loomis | |
| 3,146,470 | A | 9/1964 | Hamblin | |
| 3,174,167 | A | 3/1965 | Pauley | |

(Continued)

FOREIGN PATENT DOCUMENTS

| | | |
|---|---|---|
| EP | 993846 | 4/2000 |
| JP | H09192263 | 7/1997 |
| WO | WO8908479 | 9/1989 |

*Primary Examiner* — Daniel V Venne
(74) *Attorney, Agent, or Firm* — Stetina Brunda Garred and Brucker

(57) ABSTRACT

A swim paddle system includes a substantially planar, rigid paddle having a first side for receiving a hand of a swimmer and a second side opposing the first side with a plurality of through holes extending through the paddle from the first side to the second side, the first side having a palm region for receiving a palm of the hand and a peripheral region for receiving a thumb, an index finger, a middle finger, a ring finger, a little finger, and a wrist of the hand. At least a portion of the paddle is transparent or translucent to allow at least a portion of the hand to cast a shadow as light shines through the paddle.

18 Claims, 3 Drawing Sheets

(56) References Cited

U.S. PATENT DOCUMENTS

| | | | | | |
|---|---|---|---|---|---|
| 3,258,794 | A * | 7/1966 | Goodwin | A63B 31/08 | 441/56 |
| 3,328,812 | A | 7/1967 | Berthiot | | |
| 3,397,414 | A | 8/1968 | Webb | | |
| 3,599,258 | A * | 8/1971 | Murawski | A63B 31/10 | 441/58 |
| 3,742,539 | A | 7/1973 | Okuniewski et al. | | |
| 3,765,042 | A | 10/1973 | Montrella | | |
| 3,938,207 | A | 2/1976 | Drescher | | |
| RE22,855 | E | 6/1976 | Montrella | | |
| 4,067,081 | A | 1/1978 | Drescher | | |
| 4,548,588 | A | 10/1985 | Kosuge | | |
| 4,618,328 | A | 10/1986 | Chi | | |
| D286,904 | S | 11/1986 | Kim | | |
| 4,669,991 | A | 6/1987 | Southworth | | |
| 4,832,643 | A | 5/1989 | Schoofs | | |
| 4,913,418 | A | 4/1990 | Schluester et al. | | |
| 5,004,227 | A | 4/1991 | Hoffman | | |
| D318,894 | S | 8/1991 | Harling | | |
| D321,547 | S | 11/1991 | Albrecht | | |
| 5,167,551 | A | 12/1992 | Davis | | |
| 5,288,254 | A | 2/1994 | Elson | | |
| 5,304,080 | A | 4/1994 | Dilger | | |
| 5,367,036 | A | 12/1994 | Hull | | |
| 5,429,535 | A | 7/1995 | Liese | | |
| D363,754 | S | 10/1995 | Johnson | | |
| 5,511,998 | A | 4/1996 | Johnson | | |
| 5,516,319 | A | 5/1996 | Nessel | | |
| 5,549,294 | A | 8/1996 | Wellen et al. | | |
| D378,307 | S | 3/1997 | Desveaux | | |
| 5,643,027 | A | 7/1997 | Evans et al. | | |
| 5,647,783 | A | 7/1997 | Nessel | | |
| 5,651,710 | A | 7/1997 | Rives et al. | | |
| 5,658,224 | A | 8/1997 | Betrock | | |
| D397,187 | S | 8/1998 | Reeder | | |
| D398,362 | S | 9/1998 | Larmont | | |
| 5,842,896 | A | 12/1998 | Liveoak | | |
| 6,019,650 | A | 2/2000 | Rives et al. | | |
| D437,912 | S | 2/2001 | Chiang | | |
| D438,278 | S | 2/2001 | McCarthy | | |
| 6,183,396 | B1 | 2/2001 | Raynier | | |
| D439,299 | S | 3/2001 | Chiang | | |
| D443,013 | S | 5/2001 | Chiang | | |
| D462,410 | S | 9/2002 | Chiang | | |
| D484,559 | S | 12/2003 | Peek et al. | | |
| 6,672,993 | B2 * | 1/2004 | Stout | A63B 21/0084 | 482/55 |
| 6,898,400 | B2 | 5/2005 | Ehara | | |
| 6,899,581 | B1 | 5/2005 | Nokes | | |
| D529,117 | S | 9/2006 | Chiang | | |
| D529,569 | S | 9/2006 | Chiang | | |
| 7,179,146 | B2 | 2/2007 | Johnson | | |
| 7,267,595 | B1 * | 9/2007 | Hall | A63B 31/10 | 441/56 |
| 7,494,395 | B2 * | 2/2009 | Krikliwy | A63B 31/10 | 441/56 |
| D599,429 | S | 9/2009 | King et al. | | |
| 7,582,045 | B1 * | 9/2009 | Lombardi | A63B 21/00069 | 434/255 |
| 8,198,520 | B1 | 6/2012 | King et al. | | |
| 8,585,453 | B2 * | 11/2013 | Doyle | A63B 31/14 | 441/58 |
| D707,321 | S | 6/2014 | Lee et al. | | |
| 9,130,000 | B2 | 9/2015 | Tsuno et al. | | |
| 9,180,000 | B2 | 11/2015 | Cantournet et al. | | |
| 9,308,418 | B2 * | 4/2016 | Davis | A63B 31/10 | |
| 9,492,712 | B2 * | 11/2016 | Smith | A63B 31/04 | |
| 2004/0203301 | A1 | 10/2004 | Johnson | | |
| 2008/0200083 | A1 * | 8/2008 | Balleto | A63B 31/12 | 441/58 |
| 2009/0318041 | A1 | 12/2009 | Murphy | | |
| 2013/0309922 | A1 * | 11/2013 | Smith | A63B 31/04 | 441/56 |
| 2016/0067551 | A1 * | 3/2016 | Tilson | A63B 31/04 | 482/55 |

* cited by examiner

SWIM PADDLE

CROSS-REFERENCE TO RELATED APPLICATIONS

Not Applicable

STATEMENT RE: FEDERALLY SPONSORED RESEARCH/DEVELOPMENT

Not Applicable

BACKGROUND

Technical Field

The present disclosure relates generally to swim training, and more specifically to a swim paddle used to increase the resistance of the water to a swimmer's hand strokes.

Description of the Related Art

For purposes of training, a swimmer may desire to increase the resistance of the water to his hand strokes in order to build muscle strength or improve technique. Conventional swim paddles serve the purpose of increasing resistance. However, because the swimmer's hand is covered by the swim paddle, and because the swimmer's head may not be turned toward the paddle at all times during his stroke, it is difficult to learn proper positioning of the hand during a stroke. Moreover, it is difficult for the swimmer to self-diagnose whether his hand is positioned correctly on the swim paddle, which may result in ineffective use of the swim paddle and, in some cases, injury to the swimmer.

Accordingly, there is a need in the art for a swim paddle system that overcomes the above drawbacks accompanying the related art. Various aspects of the present disclosure address these particular needs, as will be discussed in more detail below.

BRIEF SUMMARY

In accordance with one or more aspects of the present disclosure, there is provided a swim paddle system including a substantially planar, rigid paddle that accommodates a swimmer's hand and one or more flexible straps used to fasten the paddle to the hand. All or a portion of the paddle is transparent or translucent to allow light to shine through, with the exception of an opaque peripheral edge of the paddle. As a result, the swimmer can see the position of his hand at all times while swimming. When the swimmer's head is turned toward the paddle, the swimmer can see his hand through the paddle and easily gauge whether his hand is correctly positioned. Meanwhile, light shining through the paddle casts a shadow of the swimmer's hand on the floor of the swimming pool and a shadow of the paddle's opaque peripheral edge around the shadow of the swimmer's hand. By looking at the shadows, the swimmer can easily gauge whether his hand is correctly positioned even when the swimmer's head is turned away from the paddle and toward the floor of the swimming pool.

One aspect of the embodiments of the present disclosure is a swim paddle system including a substantially planar, rigid paddle having a first side for receiving a hand of a swimmer and a second side opposing the first side with a plurality of through holes extending through the paddle from the first side to the second side, the first side having a palm region for receiving a palm of the hand and a peripheral region for receiving a thumb, an index finger, a middle finger, a ring finger, a little finger, and a wrist of the hand. At least a portion of the paddle is transparent to allow at least a portion of the hand to cast a shadow as light shines through the paddle.

At least a portion of an edge of the peripheral region may have greater opacity than the at least a portion of the paddle that is transparent. An entirety of the edge of the peripheral region may have greater opacity than the at least a portion of the paddle that is transparent.

The plurality of through holes may include two or more first holes each of whose extension through the paddle has a minimum cross-sectional area that is smaller than a minimum cross-sectional area of the extension through the paddle of one or more second holes of the plurality of through holes, the two or more first holes for receiving two ends of a flexible strap to fasten the paddle to the hand. The extension through the paddle of each of the two or more first holes may be a cylinder having a first diameter and the extension through the paddle of each of the one or more second holes may be a cylinder having a second diameter greater than the first diameter.

The swim paddle system may further include one or more flexible straps sized to fit through two or more of the plurality of through holes to fasten the paddle to the hand. The one or more flexible straps may be made of rubber. The one or more flexible straps may be hollow tubes.

The peripheral region may include a wrist sub-region, for receiving the wrist, in which an edge of the peripheral region is recessed to allow freedom of motion of the wrist.

Another aspect of the embodiments of the present disclosure is a swim paddle system including a substantially planar, rigid paddle having a first side for receiving a hand of a swimmer and a second side opposing the first side with a plurality of through holes extending through the paddle from the first side to the second side, the first side having a palm region for receiving a palm of the hand and a peripheral region for receiving a thumb, an index finger, a middle finger, a ring finger, a little finger, and a wrist of the hand. At least a portion of the paddle is translucent to allow at least a portion of the hand to cast a shadow as light shines through the paddle.

At least a portion of an edge of the peripheral region may have greater opacity than the at least a portion of the paddle that is translucent. An entirety of the edge of the peripheral region may have greater opacity than the at least a portion of the paddle that is translucent.

The plurality of through holes may include two or more first holes each of whose extension through the paddle has a minimum cross-sectional area that is smaller than a minimum cross-sectional area of the extension through the paddle of one or more second holes of the plurality of through holes, the two or more first holes for receiving two ends of a flexible strap to fasten the paddle to the hand. The extension through the paddle of each of the two or more first holes may be a cylinder having a first diameter and the extension through the paddle of each of the one or more second holes may be a cylinder having a second diameter greater than the first diameter.

The swim paddle system may further include one or more flexible straps sized to fit through two or more of the plurality of through holes to fasten the paddle to the hand. The one or more flexible straps may be made of rubber. The one or more flexible straps may be hollow tubes.

The peripheral region may include a wrist sub-region, for receiving the wrist, in which an edge of the peripheral region is recessed to allow freedom of motion of the wrist.

Another aspect of the embodiments of the present disclosure is a swim paddle system including a substantially planar, rigid paddle having a first side for receiving a hand of a swimmer and a second side opposing the first side with a plurality of through holes extending through the paddle from the first side to the second side, the first side having a palm region for receiving a palm of the hand and a peripheral region for receiving a thumb, an index finger, a middle finger, a ring finger, a little finger, and a wrist of the hand. At least a portion of the paddle is transparent or translucent to allow at least a portion of the hand to cast a shadow as light shines through the paddle.

At least a portion of an edge of the peripheral region may have greater opacity than the at least a portion of the paddle that is transparent or translucent.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The detailed description set forth below in connection with the appended drawings is intended as a description of certain embodiments of a swim paddle system. The described embodiments are not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Various aspects of the present disclosure pertain to a swim paddle system for use by a swimmer during swim training. A paddle fastened to the swimmer's hand increases the resistance of the water to the swimmer's hand strokes, which may help the swimmer build muscle strength or improve technique. Because the paddle is partially or wholly transparent or translucent, the swimmer can see the underside of his hand through the paddle. In addition, as light shines through the paddle, the swimmer's hand casts a shadow through the paddle, which may be observed by the swimmer on the floor of the swimming pool. The paddle may include an opaque peripheral edge such that the shadow of the swimmer's hand is framed by a shadow outline of the paddle. In this way, the swimmer can easily judge whether his hand is correctly positioned, both in the sense of correct stroke position and position relative to the paddle, even at times when the swimmer's head is turned away from the paddle and toward the bottom of the swimming pool.

Figure 1:
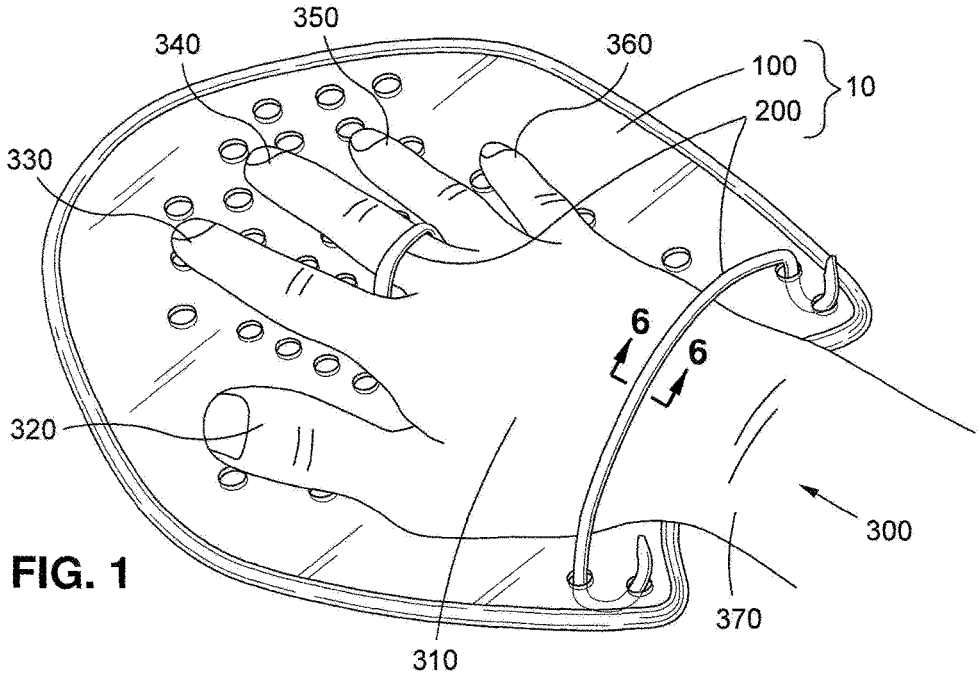
FIG. 1 is a perspective view of a swim paddle system according to an embodiment of the present disclosure, together with the hand of a swimmer.

Referring now to the drawings, FIG. 1 is a perspective view of a swim paddle system 10 according to an embodiment of the present disclosure, together with a swimmer's hand 300 having a palm 310, thumb 320, index finger 330, middle finger 340, ring finger 350, little finger 360, and wrist 370. The swim paddle system 10 includes a substantially planar, rigid paddle 100 and one or more flexible straps 200 used to fasten the paddle 100 to the swimmer's hand 300 palm-side down, i.e. with the palm 310 of the hand 300 pressed against the paddle 100. In the example of FIG. 1, two flexible straps 200 are used, one secured to the middle finger 340 and another secured to the wrist 370. The flexible straps 200 may engage with through holes of the paddle 100, to be described in more detail below. In this regard, the flexible straps 200 may be sized to fit through two or more of a plurality of through holes to fasten the paddle 100 to the hand 300.

As represented in the drawings by spaced, diagonal markings across the surface of the paddle 100, at least a portion of the paddle 100 is transparent or translucent to allow at least a portion of the hand 300 to cast a shadow as light shines through the paddle 100. In the example of the paddle 100 shown in the drawings, substantially all of the paddle 100 is transparent or translucent, with the exception of a peripheral edge 170 (see FIGS. 2 and 3) as described in more detail below. However, it is contemplated that a smaller portion of the paddle 100 may be transparent or translucent, so long as at least a portion of the hand 300 casts a shadow as light shines through the paddle 100. For example, a transparent or translucent pattern (stripes, polka dots, etc.) may be provided across the paddle 100, with the space between the pattern elements opaque. As another example, one or more transparent or translucent regions may be provided, either arbitrarily positioned or positioned in relation to the expected positions of specific parts of the hand 300. For instance, transparency or translucency might be provided in a window region corresponding to expected positions of the thumb 320 and fingers 330, 340, 350, 360 and an outer part of the palm 310, with opacity provided in a middle part of the palm 310 and elsewhere. With such schemes, at least a portion of the hand 300 may still cast a shadow as light shines through the paddle 100, allowing the swimmer to easily judge the position of his hand 300.

Figure 6:
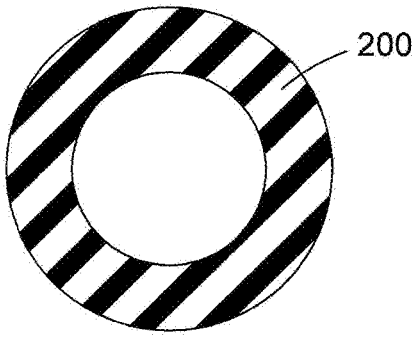
FIG. 6 is a cross section of the flexible strap shown in FIG. 1 taken along the line marked "6".

The paddle 100 may be made of hard plastic/polymers such as polypropylene polystyrene, acrylonitrile butadiene styrene (ABS) and/or polyvinyl chloride (PVC) and may be produced by known methods (e.g. injection molding or thermal deformation). Embodiments of the paddle 100 that include portions of varying opacity may be produced, for example, by a double molding process such as a two-shot injection molding process, by applying dye or paint, or by attaching a separate piece (e.g. by adhesive). However, those having ordinary skill in the art will recognize that other materials and production techniques are contemplated in the spirit of the present invention. The flexible straps 200 may be made of a flexible material such as rubber (e.g. silicone rubber or other elastomer) and may be in the form of hollow tubes (see FIG. 6). Such hollow tubes may have one or both ends diagonally cut for easier insertion into through holes 140 (see FIGS. 2 and 3).

Figure 2:
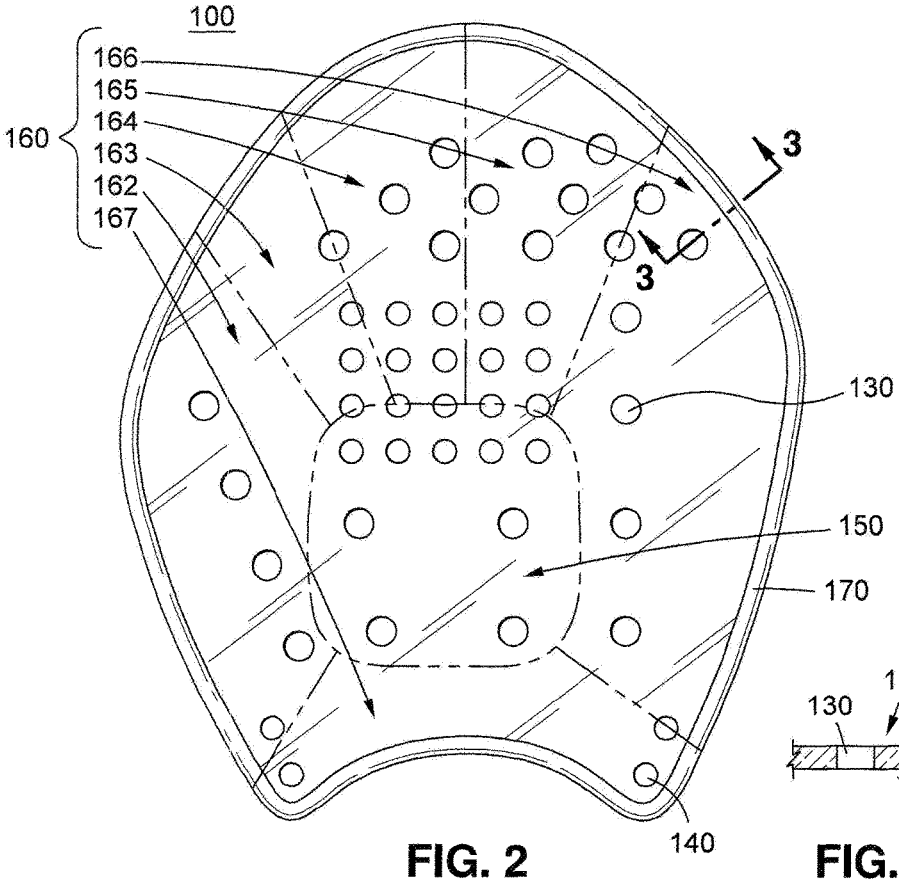
FIG. 2 is a top view of a paddle of the swim paddle system shown in FIG. 1.
Figure 3:
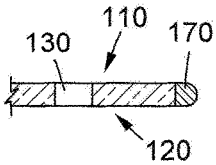
FIG. 3 is a partial cross section of the paddle of FIG. 2 taken along the line marked "3"
Figure 4:
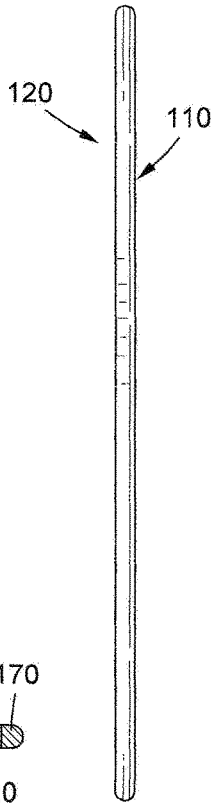
FIG. 4 is a side view of the paddle of FIG. 2.

FIG. 2 is a top view of the paddle 100, FIG. 3 is a partial cross section of the paddle 100 taken along the line marked "3" in FIG. 2, and FIG. 4 is a side view of the paddle 100. As best understood from FIGS. 3 and 4, the paddle 100 has a first side 110 for receiving the swimmer's hand 300 and a second side 120 opposing the first side 110. A plurality of through holes 130, 140 extend through the paddle 100 from the first side 110 to the second side 120. The through holes 130, 140 may serve several purposes, including reducing resistance of the water to the paddle 100, allowing water to pass near the swimmer's hand 300 to improve the "feel" of swimming with the paddle 100, and providing engagement points for the flexible straps 200. In the example of the paddle 100 shown in FIGS. 1-4, the plurality of through holes 130, 140 includes first holes 140 for providing engagement points for the flexible straps 200 and second holes 130 for reducing resistance of the water and improving the "feel" of swimming. In light of the first holes 140 not being designed for the passage of water, they are smaller than the second holes 130. However, it is contemplated that all of the through holes 130, 140 may be the same size and/or shape irrespective of their purposes, or that the same through holes 130, 140 may serve both for the passage of water and as engagement points for the flexible straps 200.

The first side 110 of the paddle 100 may generally be thought of as having a palm region 150 for receiving the palm 310 of the hand 300 and a peripheral region 160 for receiving the thumb 320, index finger 330, middle finger 340, ring finger 350, little finger 360, and wrist 370 of the hand 300. The precise contours of the palm region 150 and peripheral region 160 may vary, with the peripheral region 160 denoting a region whose edge 170 defines the outermost extent of the paddle 100. As shown in FIG. 2, the peripheral region 160 may generally be thought of as having a thumb sub-region 162 for receiving the thumb 320, an index finger sub-region 163 for receiving the index finger 330, a middle finger sub-region 164 for receiving the middle finger 340, a ring finger sub-region 165 for receiving the ring finger 350, a little finger sub-region 166 for receiving the little finger 360, and a wrist sub-region 167 for receiving the wrist 370. The precise contours of the sub-regions 162, 163, 164, 165, 166, 167 may vary.

In general, consideration of a palm region 150 and sub-regions 162, 163, 164, 165, 166, 167 of a peripheral region 160 during design of the paddle 100 may influence placement, size, and shape of the through holes 130, 140. For example, second holes 130 may be placed, sized, and shaped so as to allow water to flow against, near, or far from the palm 310, thumb 320, fingers 330, 340, 350, 360, and wrist 370 depending on the particular purposes of the second holes 130 (e.g. to reduce resistance at a particular part of the paddle 100, to allow the sensation of water flowing past finger tips, etc.). Along the same lines, first holes 140 may be placed, sized, and shaped so as to serve as engagement points for the flexible straps 200 at effective locations. In the example shown in FIGS. 1-4, for example, four first holes 140 are shown in, or near the wrist sub-region 167 to be used as engagement points for a flexible strap 200 secured to the wrist 370, and an array of twenty first holes 140 are shown extending from the palm region 150 into the index finger, middle finger, and ring finger sub-regions 163, 164, 165 to be used as engagement points for a flexible strap 200 secured to the middle finger 340 or other finger. Such a plurality of first holes 140 may be provided in order to provide for varying fastening methodologies depending on the swimmer's particular hand 300 and preferences.

Consideration of a palm region 150 and sub-regions 162, 163, 164, 165, 166, 167 of a peripheral region 160 during design of the paddle 100 may further influence the overall shape and size of the paddle 100. In this regard, as best seen in FIGS. 1 and 2, the paddle 100 may be designed to be roughly "hand-shaped," with the edge 170 of the peripheral region 160 extending farther in the vicinity of some sub-regions (e.g. middle finger and ring finger sub-regions 164, 165) than in the vicinity of other sub-regions (e.g. thumb, index finger, and little finger sub-regions 162, 163, 166) in order to accommodate a typical hand shape. Furthermore, as best seen in FIGS. 1 and 2, the paddle 100 may be designed such that the edge 170 of the peripheral region 160 is recessed in the wrist sub-region 167 to allow freedom of motion of the wrist 370.

As described above, the at least a portion of the paddle 100 that is transparent or translucent may be less than the entirety of the paddle 100 in some cases. In this regard, consideration of a palm region 150 and sub-regions 162, 163, 164, 165, 166, 167 of a peripheral region 160 during design of the paddle 100 may further influence the selective placement of one or more transparent or translucent portions as described above, such that at least a portion of the hand 300 is allowed to cast a shadow as light shines through the paddle 100.

At least a portion of the edge 170 of the peripheral region 160 may have greater opacity than the at least a portion of the paddle 100 that is transparent or translucent. Due to the greater opacity of the edge 170, the edge 170 casts a shadow as light shines through the paddle 100. In the example of the paddle 100 shown in the drawings, an entirety of the edge 170 of the peripheral region 160 has greater opacity than the at least a portion of the paddle 100 that is transparent or translucent. That is, the part with greater opacity extends all the way around the paddle 100 without breaks (and inward into the peripheral region 160 far enough to cast a noticeable shadow, e.g. approximately one-eighth to one-quarter of an inch from the outermost extent of the paddle 100). However, it is also contemplated that only a smaller portion of the edge 170 may have the greater opacity. For example, the greater opacity can be provided as stripes or another pattern along the edge 170 or the greater opacity can be provided only in select parts of the edge 170 (e.g. in select sub-regions 162, 163, 164, 165, 166, 167, such as everywhere except the wrist sub-region 167 where the edge 170 is generally covered by the swimmer's arm anyway).

The greater opacity of the at least a portion of the edge 170 may block substantially all light or may allow some light to pass through. For example, the paddle 100 may be transparent everywhere except the edge 170 and translucent at the edge 170. The greater opacity of the translucent edge 170 would still visibly cast a shadow, though it might be a lighter shadow than the shadow cast by the hand.

As shown in the cross-sectional view of FIG. 3, the edge 170 may be rounded and may be flush with the first and second sides 110, 120 of the paddle 100. Alternatively, the edge 170 may be raised (i.e. thicker) relative to the rest of the paddle 100, protruding out from the first side 110 and/or the second side 120, or sunken (i.e. thinner) relative to the rest of the paddle 100, receding in from the first side 110 and/or the second side 120. Such variations may result depending on how the paddle 100 is manufactured, e.g. if a separate piece is attached by adhesive, and may provide certain advantages such as an enhanced feel or grip of the paddle 100 or a tactile indication that the hand 300 is close to the edge 170.

FIG. 3 also shows an example of a second hole 130 whose extension through the paddle 100 can be understood as being a cylinder in view of FIGS. 2 and 3. Likewise, the extensions of each of the through holes 130, 140 through the paddle 100 may be a cylinder. As noted above, first holes 140 (which may serve as fastening points for flexible straps 200) may be smaller than second holes 130 (which may serve to allow water to pass through the paddle 100). In particular, in the case of cylindrical through holes 130, 140, the cylindrical extension of second holes 130 may have a greater diameter than the cylindrical extension of first holes 140. More generally, in the case of through holes 130, 140 having arbitrary extensions through the paddle, a minimum cross-sectional area of the extension through the paddle 100 of a first hole 140 used for a flexible strap 200 may be smaller than a minimum cross-sectional area of the extension through the paddle 100 of a second hole 130 used for water passage.

As shown in FIG. 4, the paddle 100 may be substantially planar. It is contemplated that the paddle 100 may not be perfectly planar, both in the sense that the paddle 100 may have bumps, indentations, etc. and in the sense that the paddle 100 may be deformed in various ways to depart from a planar shape in minor aspects. For example, the paddle 100 may be deformed in the direction of the first side 110 so as to protrude slightly in the vicinity of the palm region 150. This may produce a more comfortable or natural feel against the palm 310 of the swimmer's hand 300. The paddle 100 may also have other minor three-dimensional features, e.g. fin extensions, ridges, a slight curvature, while maintaining an overall shape that is substantially planar. The paddle 100 may be approximately one to three sixteenths of an inch thick and may have varying degrees of rigidity, depending on material, so long as it can effectively function as a swim paddle.

The swim paddle system 10 shown in FIGS. 1-4 is depicted as including a single paddle 100 designed for a swimmer's right hand. However, the swim paddle system 10 may further include a second paddle 100 for the swimmer's left hand, which may be a substantial mirror image of the paddle 100 shown in the drawings and have substantially the same features. Additional flexible straps 200 may also be provided (e.g. two for each paddle 100). To distinguish left and right paddles 100 for ease of use, the paddles 100 might be respectively marked "L" or "LEFT" and "R" or "RIGHT" or given some other notation or distinguishing characteristic. Alternatively, the paddles 100 may in fact be identical, with the first side 110 of one being used on the swimmer's right hand and the second side 120 of the other being used on the swimmer's left hand. It is further contemplated that the paddles 100 may be produced in various sizes (e.g. XXS, XS, S, M, L, XL, XXL) to accommodate a wide variety of hand sizes, and that the size might be indicated on the paddle 100.

Figure 5:
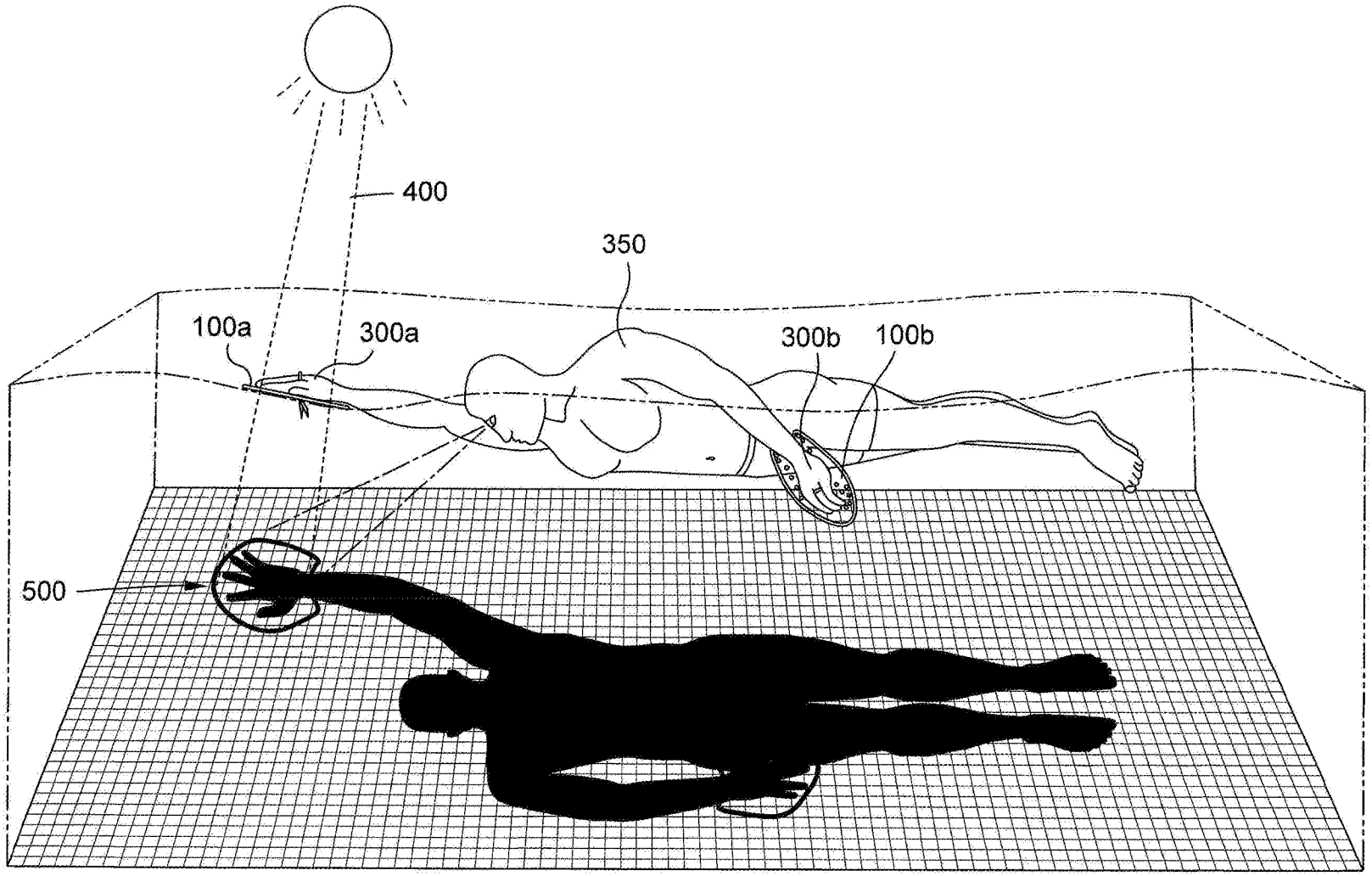
FIG. 5 is a schematic illustration of a swim paddle system being used by a swimmer according to an embodiment of the present disclosure.

FIG. 5 is a schematic illustration of a swim paddle system being used by a swimmer 350 according to an embodiment of the present disclosure. The swim paddle system may be substantially the same as the swim paddle system 10 shown in FIGS. 1-4, with the paddle 100*a* fastened to the swimmer's right hand 300*a* and the paddle 300*b* fastened to the swimmer's left hand 300*b* corresponding respectively to the paddle 100 and its substantial mirror image. As the swimmer 350 swims through the pool, light 400 (e.g. from the sun or overhead lights) shines down through the paddle 100*a* and casts shadows 500 on the floor of the pool. Due to the transparency or translucency of the paddle 100*a*, the shadows 500 include a shadow of the swimmer's hand 300*a*, which has greater opacity than the transparent or translucent portion of the paddle 100*a*. In addition, due to the greater opacity of the edge 170 of the peripheral region 160 of the paddle 100*a*, the shadows 500 include a shadow of the edge 170, giving positional context to the shadow of the hand 300*a* relative to the paddle 100*a*. By looking at the shadows 500, the swimmer 350 can easily see both the absolute position of his hand 300*a* (e.g. its shape mid-stroke) and the relative position of his hand 300*a* relative to the paddle 100*a*. The swimmer 350 can thus improve his technique and self-diagnose his use of the paddle 100*a* to improve its effectiveness and safety during training.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A swim paddle system comprising:

a paddle that is substantially planar and rigid having a first side for receiving a hand of a swimmer and a second side opposing the first side with a plurality of through holes extending through the paddle from the first side to the second side, the first side having a palm region for receiving a palm of the hand and a peripheral region for receiving a thumb, an index finger, a middle finger, a ring finger, a little finger, and a wrist of the hand, the peripheral region being a region with an edge that defines the outermost extent of the paddle;

wherein at least a portion of the paddle is transparent to allow at least a portion of the hand to cast a shadow as light shines through the paddle; and wherein at least a portion of the edge of the peripheral region has greater opacity than the at least a portion of the paddle that is transparent, the at least a portion of the edge of the peripheral region being provided along the edge such that the shadow of the hand is framed by a shadow outline of the paddle as the light shines through the paddle.

2. The swim paddle system of claim 1, wherein an entirety of the edge of the peripheral region has greater opacity than the at least a portion of the paddle that is transparent.

3. The swim paddle system of claim 1, wherein the plurality of through holes includes two or more first holes each of whose extension through the paddle has a minimum cross-sectional area that is smaller than a minimum cross-sectional area of the extension through the paddle of one or more second holes of the plurality of through holes, the two or more first holes for receiving two ends of a flexible strap to fasten the paddle to the hand.

4. The swim paddle system of claim 3, wherein the extension through the paddle of each of the two or more first holes is a cylinder having a first diameter and the extension through the paddle of each of the one or more second holes is a cylinder having a second diameter greater than the first diameter.

5. The swim paddle system of claim 1, further comprising one or more flexible straps sized to fit through two or more of the plurality of through holes to fasten the paddle to the hand.

6. The swim paddle system of claim 5, wherein the one or more flexible straps are made of rubber.

7. The swim paddle system of claim 6, wherein the one or more flexible straps are hollow tubes.

8. The swim paddle system of claim 1, wherein the peripheral region includes a wrist sub-region, for receiving the wrist, in which an edge of the peripheral region is recessed to allow freedom of motion of the wrist.

9. A swim paddle system comprising:

a paddle that is substantially planar and rigid having a first side for receiving a hand of a swimmer and a second side opposing the first side with a plurality of through holes extending through the paddle from the first side to the second side, the first side having a palm region for receiving a palm of the hand and a peripheral region for receiving a thumb, an index finger, a middle finger, a ring finger, a little finger, and a wrist of the hand, the peripheral region being a region with an edge that defines the outermost extent of the paddle;

wherein at least a portion of the paddle is translucent to allow at least a portion of the hand to cast a shadow as light shines through the paddle; and wherein at least a portion of the edge of the peripheral region has greater opacity than the at least a portion of the paddle that is translucent, the at least a portion of the edge of the peripheral region being provided along the edge such that the shadow of the hand is framed by a shadow outline of the paddle as the light shines through the paddle.

10. The swim paddle system of claim 9, wherein an entirety of the edge of the peripheral region has greater opacity than the at least a portion of the paddle that is translucent.

11. The swim paddle system of claim 9, wherein the plurality of through holes includes two or more first holes each of whose extension through the paddle has a minimum cross-sectional area that is smaller than a minimum cross-sectional area of the extension through the paddle of one or more second holes of the plurality of through holes, the two or more first holes for receiving two ends of a flexible strap to fasten the paddle to the hand.

12. The swim paddle system of claim 11, wherein the extension through the paddle of each of the two or more first holes is a cylinder having a first diameter and the extension through the paddle of each of the one or more second holes is a cylinder having a second diameter greater than the first diameter.

13. The swim paddle system of claim 9, further comprising one or more flexible straps sized to fit through two or more of the plurality of through holes to fasten the paddle to the hand.

14. The swim paddle system of claim 13, wherein the one or more flexible straps are made of rubber.

15. The swim paddle system of claim 14, wherein the one or more flexible straps are hollow tubes.

16. The swim paddle system of claim 9, wherein the peripheral region includes a wrist sub-region, for receiving the wrist, in which an edge of the peripheral region is recessed to allow freedom of motion of the wrist.

17. A swim paddle system comprising:

a paddle that is substantially planar and rigid having a first side for receiving a hand of a swimmer and a second side opposing the first side with a plurality of through holes extending through the paddle from the first side to the second side, the first side having a palm region for receiving a palm of the hand and a peripheral region for receiving a thumb, an index finger, a middle finger, a ring finger, a little finger, and a wrist of the hand, the peripheral region being a region with an edge that defines the outermost extent of the paddle;

wherein at least a portion of the paddle is transparent or translucent to allow at least a portion of the hand to cast a shadow as light shines through the paddle; and wherein at least a portion of the edge of the peripheral region has greater opacity than the at least a portion of the paddle that is transparent or translucent, the at least a portion of the edge of the peripheral region being provided along the edge such that the shadow of the hand is framed by a shadow outline of the paddle as the light shines through the paddle.

18. The swim paddle system of claim 17, wherein an entirety of the edge of the peripheral region has greater opacity than the at least a portion of the paddle that is transparent or translucent.

* * * * *